US007056009B2

(12) United States Patent
Jägle et al.

(10) Patent No.: US 7,056,009 B2
(45) Date of Patent: Jun. 6, 2006

(54) DISPERSING TOOL WITH AN INNER SHAFT ROTATABLE WITHIN A HOLLOW SHAFT TO CREATE A PUMPING EFFECT

(75) Inventors: Peter Jägle, Ballrechten-Dottingen (DE); Axel Kaufmann, Grissheim (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 0 days.

(21) Appl. No.: 11/054,809

(22) Filed: Feb. 10, 2005

(65) Prior Publication Data

US 2005/0190642 A1 Sep. 1, 2005

(30) Foreign Application Priority Data

Feb. 27, 2004 (DE) ..... 10 2004 009 708

(51) Int. Cl.
*B01F 7/00* (2006.01)

(52) U.S. Cl. ..... 366/129; 366/305

(58) Field of Classification Search ..... 366/129, 366/279, 262–265, 270, 302, 305, 342–343; 241/2, 46.11, 246; 435/306.1
See application file for complete search history.

(56) References Cited

U.S. PATENT DOCUMENTS 3,299,924 A * 1/1967 Hanschitz ..... 241/282.2
3,556,414 A * 1/1971 Eberly Jr. ..... 241/1
3,666,187 A * 5/1972 Norris ..... 241/89.4
3,724,765 A * 4/1973 Rohrbaugh et al. ..... 241/46.06
3,941,317 A * 3/1976 Kanor ..... 241/21
4,002,326 A * 1/1977 Brogli et al. ..... 366/264
4,307,846 A * 12/1981 Spelsberg ..... 241/246
4,505,433 A * 3/1985 Selenke ..... 241/46.01
4,509,695 A * 4/1985 Bessman ..... 241/2
4,715,545 A * 12/1987 Hanifl et al. ..... 241/169.1
4,745,068 A 5/1988 Godfrey et al.
4,828,395 A * 5/1989 Saito et al. ..... 366/143
5,174,508 A * 12/1992 Martin ..... 241/21
5,533,683 A * 7/1996 Fay et al. ..... 241/169
5,731,199 A * 3/1998 Roggero ..... 435/306.1
5,829,696 A * 11/1998 DeStefano et al. ..... 241/169
6,398,402 B1 6/2002 Thomas et al.
6,863,431 B1 3/2005 Yacko et al.
2003/0206485 A1* 11/2003 Yacko et al. ..... 366/343
2005/0058019 A1* 3/2005 Jahn et al. ..... 366/295
2005/0190642 A1* 9/2005 Jagle et al. ..... 366/129

FOREIGN PATENT DOCUMENTS

GB 2250930 A * 6/1992
WO 03/086598 * 10/2003

* cited by examiner

*Primary Examiner*—Charles E. Cooley
(74) *Attorney, Agent, or Firm*—Volpe and Koenig, P.C.

(57) ABSTRACT

A dispersing tool (1) is provided having a hollow shaft (2), which has an open, laterally slotted region on its free end (4) that faces away from a drive that is at the bottom in the position of use, and with an inner shaft (3), which can rotate in this hollow shaft (2) and which has a dispersing tool (5) interacting with this hollow shaft in the region of the slotted end of the hollow shaft (2). Upon rotation, the inner shaft creates a pumping effect directed towards the free end (4). To counteract the pumping effect of a smooth inner shaft in a direction towards the drive and simultaneously to prevent eccentricities in the profile of the inner shaft (3) and to guarantee simple manufacturing, the inner shaft (3) has at least one section (6) with an increasing cross section and the cross section increases from the drive side toward the free end (4).

22 Claims, 3 Drawing Sheets

DISPERSING TOOL WITH AN INNER SHAFT ROTATABLE WITHIN A HOLLOW SHAFT TO CREATE A PUMPING EFFECT

BACKGROUND

The invention relates to a dispersing tool with a hollow shaft, which has an open, laterally slotted region at its free end that faces away from a drive and that is at the bottom in the position of use, and with an inner shaft, which can rotate in this hollow shaft and which has a dispersing rotor interacting with this hollow shaft in the region of the slotted end of the hollow shaft, wherein as the inner shaft rotates, it creates a pumping effect directed towards the free end.

A dispersing device of this type is known from U.S. Pat. No. 6,398,402 B1. In this publication, the inner shaft with a helical thread arranged thereon, which has the mentioned pumping effect in the direction towards the working end, is housed in a stationary, rigid hollow shaft, where both of these shafts are aligned with their working ends essentially downwards and arranged especially vertically in the position of use. This should prevent a pumping effect in the opposite direction due to the inner shaft and its formation while the inner shaft rotates. However, at the very high rpm values that are to be made available by such devices, there is the risk that displacements of the inner shaft will cause the thread to come into contact with the inner side of the hollow shaft, which could lead to worn and rubbed-off parts and these in turn could lead to undesired and disruptive fillers in the material to be dispersed. In addition, such an inner shaft can then become heavy if it is to be composed of metal. The thread on the inner shaft produces unbalanced masses, which differ over the profile of the inner shaft and which likewise can lead to undesired deformations and accordingly to contact with the hollow shaft, which is arranged at only a minimal distance.

SUMMARY

Therefore, the objective of the invention is to create a dispersing tool of the type mentioned in the introduction, with which the pumping effect of a smooth inner shaft can act opposite the direction towards the drive, wherein eccentricities in the profile of the inner shaft are nonetheless prevented and also manufacturing from metal is be possible in a simple way.

This problem, which at first glance appears to be contradictory, is solved in that the inner shaft features at least one section with a cross section that changes in the axial direction and this cross section increases from the drive side towards the free end.

Tests have shown that when this inner shaft rotates within fluid rising in the stationary hollow shaft, this fluid is drawn outwards due to centrifugal force to the region with the increasing cross section, whereby it is necessary that fluid flows across the increasing cross section from top to bottom, thus the fluid is drawn in the direction towards the free end. Accordingly, the changing cross section produces a motion vector acting on the fluid from the drive towards the free end, so that fluid located in the hollow shaft can be drawn away from the drive without requiring a feeding screw with corresponding eccentricities and resulting unbalanced masses on the outer side of the inner shaft.

In one configuration of the dispersing tool according to the invention that has proven to be effective, the cross section of the section is at least point-symmetric relative to the longitudinal center axis of the inner shaft. This configurations achieves a uniform load on the inner shaft and drawing effect in the relevant region or regions while preventing unbalanced masses, so that the disruptive pumping effect in the direction towards the drive can be optimally compensated and eliminated.

It is especially advantageous when the inner shaft has several, especially several equal sections with increasing cross section. Therefore, the described drawing effect can be increased and better distributed, above all it can be designed or tuned such that just enough fluid is drawn or displaced from the hollow shaft downstream or in the direction towards the free end so that suctioning of air from above into the hollow shaft with corresponding entrance into the fluid is prevented.

Preferably, two to ten, especially three, four, or eight sections with changing cross section are distributed over the length of the inner shaft.

In addition, in the sense of a constant drawing effect in the direction towards the free end, it has proven to be advantageous in one embodiment of the dispersing tool when the sections with increasing cross section are arranged on the inner shaft at least at a predominantly uniform spacing.

Here, configurations have proven to be especially advantageous, in which the open spacing between the individual sections with changing cross section correspond in their axial dimension to approximately one-half, two times, or three times this value or to an intermediate value.

Other configuration of the dispersing tool according to the invention relate to dimensioning and size relationships, especially of the section or sections with changing cross section. Thus, it is advantageous, for example, if the angle enclosed by a meridian line of a section (6) with changing cross section and a line parallel to the longitudinal axis of the inner shaft (3) equals approximately 10° to 60°, preferably approximately 15° to 45°, especially approximately 20° to 30°. In a different configuration, the axial extent of the section (6) with increasing cross section equals between approximately one-half and two times its greatest diameter; in particular, it is approximately the same size as this largest diameter.

One embodiment of the invention, which has an essentially cylindrical projection, whose diameter corresponds to approximately the largest diameter of the section, arranged at the end of one or more sections (6) with changing cross section facing away from the drive side, is advantageous both in terms of manufacturing and also for stabilizing the inner shaft. The projections have the effect that, first, inner shafts manufactured from plastic in an injection-molding method can be removed easily and without disruptive excess from the molds after the manufacturing process. Thus, the finishing work is kept to a minimum as much as possible. Second, the projections can provide an additional support function, especially in the region of strong deflection of the inner shaft.

In another configuration of the invention, the inner shaft features minimal spacing between the regions with changing cross section in a middle region between the drive side and the working end in order to counteract the deflection of the inner shaft, which is strongest at these locations, or to distribute possible contact with the inner side of the hollow shaft to several positions.

It is especially advantageous when the section with increasing cross section next to the free end is offset approximately into the middle of a lateral outlet opening of the hollow shaft or relative to this in the direction towards the drive, especially completely outside the outlet opening in this direction. Therefore, the drawing effect in the region of the free end can be deflected outwards, so that the fluid to be treated remains in the region from the bottom side up to this opening due to hydrostatic pressure and air entry into this fluid can be prevented as much as possible.

In the various embodiments of the dispersing tool, different spatial configurations are conceivable. Especially advantageous are those, in which the meridian line of the sections with changing cross section has a constant profile up to its greatest radial extent, especially with a straight line, convex curve and/or concave curve.

Configurations of the dispersing tool, in which the meridian line of the sections with changing cross section leads back in a simple way from the point of greatest extent in the direction towards the inner shaft, are advantageous in terms of manufacturing. Here, the meridian line preferably runs from the point of its greatest radial extent in a curved or straight line, especially in a plane perpendicular to the axis of the inner shaft, to its end facing the free end of the inner shaft.

In one preferred embodiment, the sections with changing cross section extend out relative to the surface of the inner shaft at least in the region of the greatest cross section. In this way, an inner shaft of greater stability can be created relative to an arrangement, in which these sections are worked into the profile of the inner shaft. Here it is also especially favorable also for manufacturing when the smallest cross section of the section with changing cross section corresponds to the cross section of the inner shaft and thus the entire section projects from the inner shaft. On the other hand, however, it is also conceivable that the largest cross section of the section with changing cross section corresponds to the cross section of the inner shaft and the sections are worked into or inserted into the inner shaft arranged relative to each other in this way. Depending on the profile of the meridian line of each section, more or less long axis-parallel surface parts of the inner shaft are produced.

For a good drawing effect with simultaneously the best possible circulation, it is preferable when the section with changing cross section is rotationally symmetric relative to the longitudinal middle axis of the inner shaft at least region-by-region and/or has circular cross sections.

Finally, to be able to manufacture the dispersing tool simply and favorably, it is advantageous when the inner shaft is manufactured from one or more metallic materials and/or plastics. Manufacturing with composites of the mentioned materials or assembling the inner shaft from several pieces of the same and/or different materials is also possible.

BRIEF DESCRIPTION OF THE DRAWINGS

In the following, embodiments of the invention are described in more detail with reference to the figures of the drawing. Shown in partially schematic representation are.

DETAILED DESCRIPTION OF THE PREFERRED EMBODIMENTS

Figure 1:
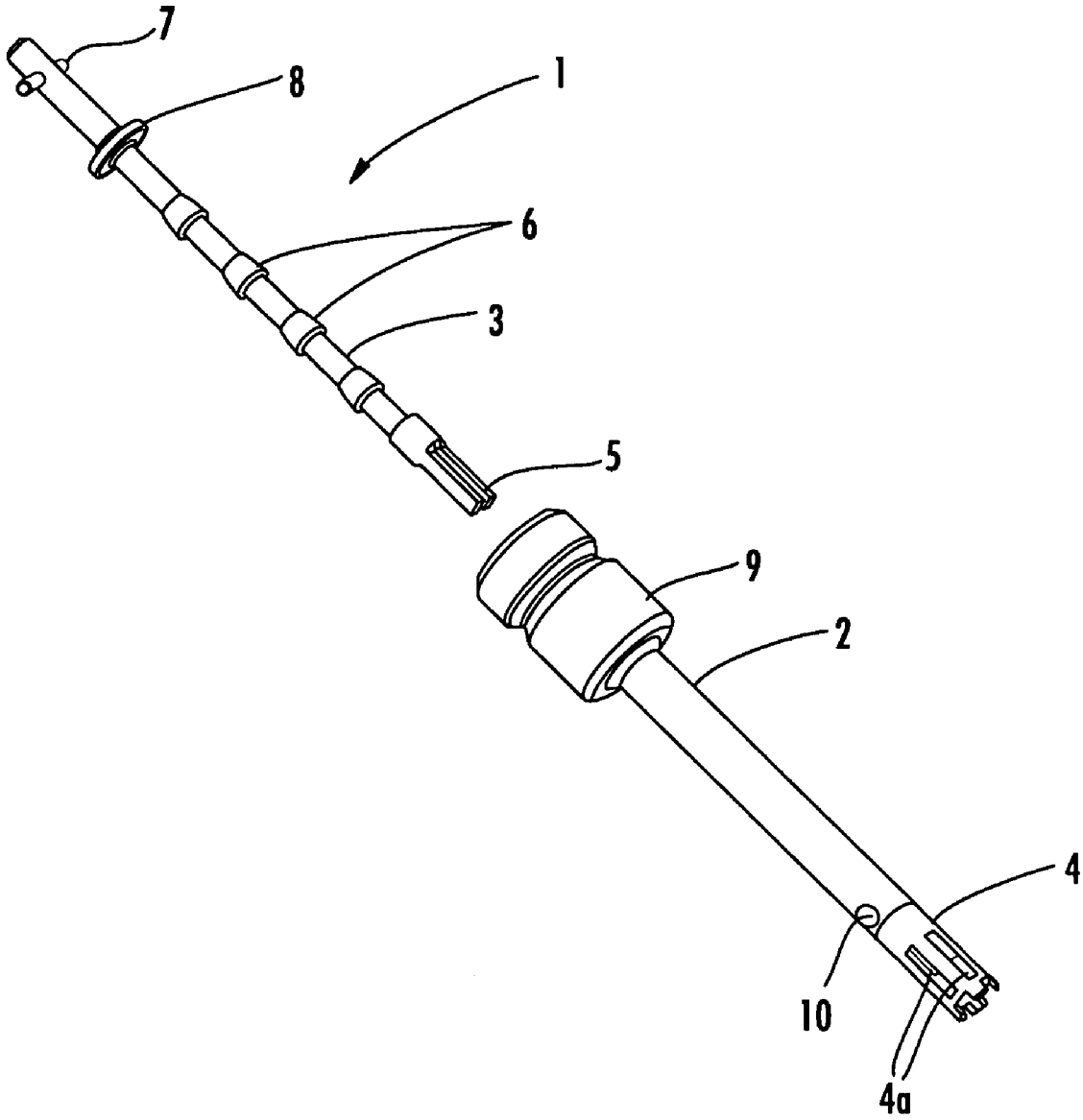
FIG. 1 is a side view of a first embodiment of a dispersing tool according to the invention with a hollow shaft and an inner shaft to be inserted into the hollow shaft before assembly.

All of the figures show a dispersing tool designated as a whole with 1. The dispersing tool 1 has a hollow shaft 2, which has an open, laterally slotted region on its free end 4, which faces away from a not shown drive and which is at the bottom in the position of use. In FIG. 1, the slots 4*a* can be seen clearly. When the dispersing tool 1 is being used, in the hollow shaft 2 there is a rotating inner shaft 3, which is manufactured from a metallic and/or plastic material and which has a dispersing rotor 5 interacting with this hollow shaft in the region of the slotted end 4 of the hollow shaft 2. When the dispersing tool 1 is being used, this dispersing rotor 5 extends into a not further described container, in which the material to be dispersed is located. When it rotates, the inner shaft 3 causes a pumping effect directed towards the free end 4 and is distinguished in that it has sections 6 with a cross section in the axial extension direction of the inner shaft 3, wherein the cross section increases from the drive side toward the free end 4. The cross sections of the sections 6 are especially point-symmetric or rotationally symmetric, preferably circular, relative to the longitudinal middle axis of the inner shaft 3.

Figure 2:
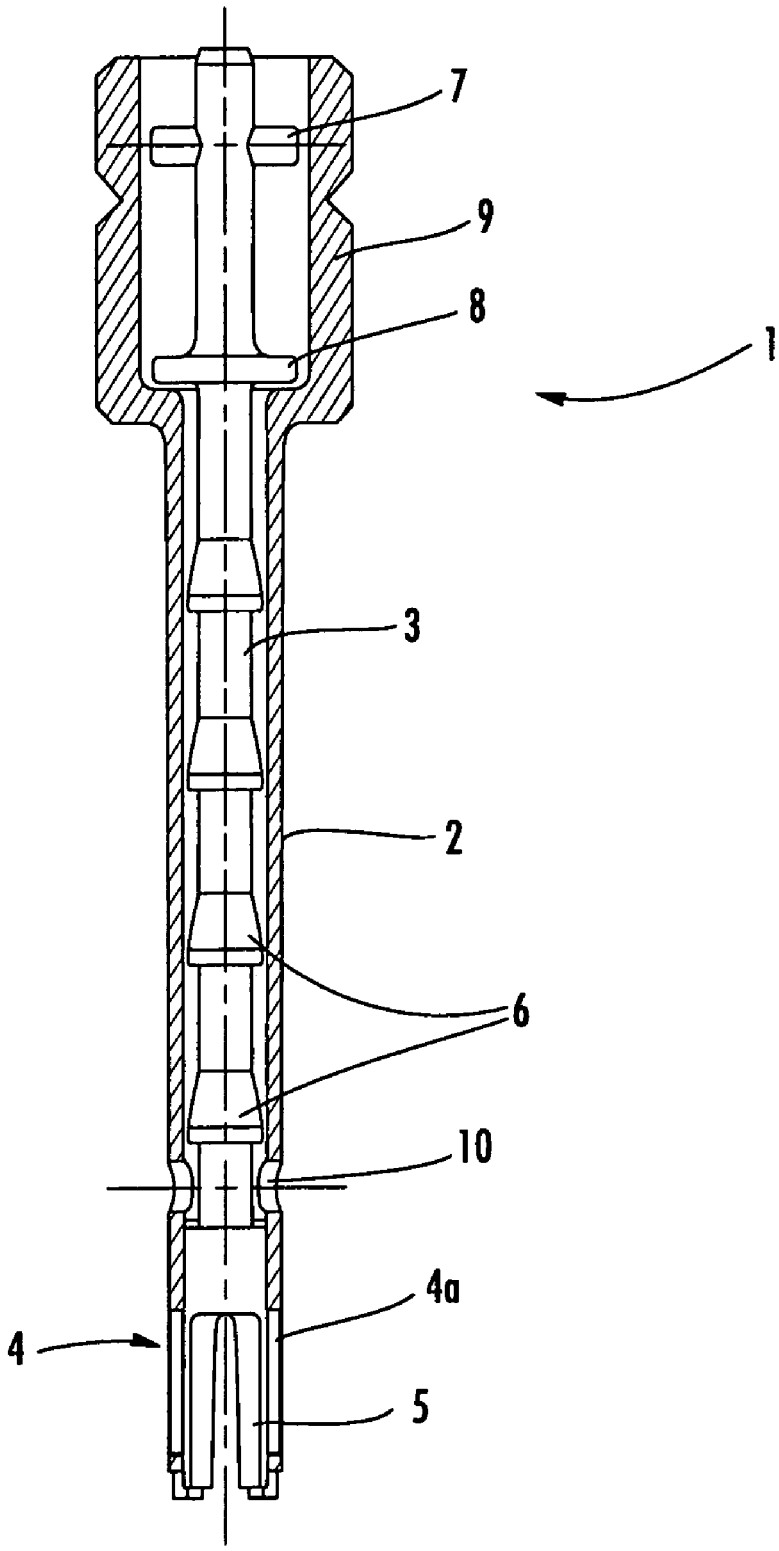
FIG. 2 is a longitudinal section of a dispersing tool from FIG. 1, in which the inner shaft has been inserted into the hollow shaft.

FIGS. 1 and 2 show a first embodiment of the dispersing tool 1, wherein FIG. 1 shows the inner shaft 3 before insertion into the hollow shaft 2, while said inner shaft 3 is already located in the hollow shaft 2 in FIG. 2. The inner shaft 3 has on its end facing the drive two cylindrical, vertical pegs 7 offset by 180° for engaging the drive, as well as a disk-like collar 8 on the driven side, which is arranged on the inner shaft and which is used as a sliding bearing for the inner shaft 3. In the assembled state of the dispersing tool 1, this part of the inner shaft 3 is housed in a cylindrical recess of the connecting piece 9 of the hollow shaft 2, which is used for connecting the tool 1 to the drive.

In a continuation of the inner shaft 3 towards the free end 4, four sections 6 with increasing cross section can be seen, which in the present case are each embodied the same and are spaced uniformly, wherein the open spacing between the sections 6 corresponds to approximately two times an axial dimension of the shaft. Starting from the surface of the inner shaft 3, the meridian line of the sections 6 with changing cross section extends continuously up to its greatest radial extent in a straight line, so that the smallest cross section of the sections 6 with changing cross section corresponds to the cross section of inner shaft 3. The meridian line then runs from the point of its greatest radial extent at its end facing the free end of the inner shaft back to the inner shaft in a plane perpendicular to the inner shaft axis.

Likewise, it can be taken from FIGS. 1 and 2 that for influencing the drawing effect, the section 6 with increasing cross section next to the free end 4 is arranged completely outside of a lateral outlet opening 10 of the hollow shaft 2, through which the fluid drawn by the pumping effect can be discharged outwards from the hollow shaft 2. Finally, in this case it can also be clearly seen that the sections 6 with changing cross section are completely rotationally symmetric and have circular cross sections relative to the longitudinal middle axis of the inner shaft 3.

Figure 3:
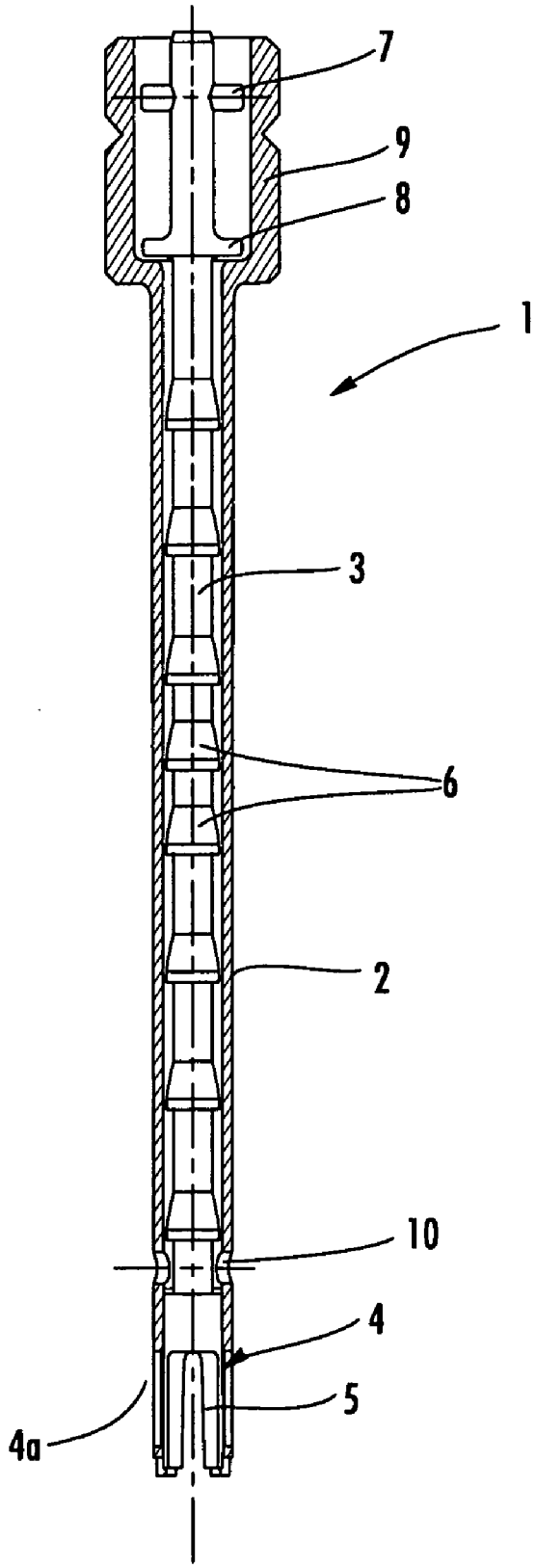
FIG. 3 is a longitudinal section of another embodiment of the dispersing tool with a lengthened shaft.

The embodiment of the dispersing tool 1 shown in FIG. 3 differs from that shown in FIGS. 1 and 2 essentially in that it has a longer shaft and accordingly more sections 6, in this case eight sections 6, with changing cross section are arranged on the inner shaft 3. Based on the length of the shaft and the goal of stabilizing this shaft, these sections no longer have uniform spacing relative to each other, but instead, between the sections with changing cross section, the spacing in a middle region of the inner shaft 3 is smaller, which produces the already previously mentioned advantages. The dispersing tool of FIG. 3 corresponds generally to that from FIGS. 1 and 2.

Therefore, FIGS. 1 to 3 show a dispersing tool 1 with a hollow shaft 2, which has an open, laterally slotted region at its free end 4 that faces away from a drive and that is at the bottom in the position of use, and with an inner shaft 3, which can rotate in this hollow shaft 2 and which has in the region of the slotted end of the hollow shaft 2 a dispersing rotor 5 interacting with this hollow shaft, wherein when it rotates, the inner shaft 3 causes a pumping effect directed towards the free end. To counteract the pumping effect of a smooth inner shaft in the direction towards the drive and simultaneously to prevent eccentricities in the profile of the inner shaft 3 and to guarantee simple manufacturing, the inner shaft 3 is provided with at least one section 6 with an increasing cross section and the cross section increases from the drive side toward the free end.

The embodiments show dispersing tools 1 with a hollow shaft 2, which has an open, laterally slotted region on its free end 4 that faces away from a drive and that is at the bottom in the position of use, and with an inner shaft 3, which can rotate in this hollow shaft 2 and which has a dispersing rotor 5 interacting with this hollow shaft in the region of the slotted end of the hollow shaft 2, wherein when it rotates, the inner shaft causes a pumping effect directed towards the free end 4. To counteract the pumping effect of a smooth inner shaft in the direction towards the drive and simultaneously to prevent eccentricities in the profile of the inner shaft 3 and to guarantee simple manufacturing, it is proposed that the inner shaft 3 has at least one section 6 with an increasing cross section and the cross section increases from the drive side toward the free end 4.

The invention claimed is:

1. Dispersing tool (1) comprising a hollow shaft (2), which has an open, laterally slotted region on a free end (4) thereof that faces away from a drive and that is at a bottom location in a position of use, an inner shaft (3), which can rotate in the hollow shaft (2) and which has a dispersing rotor (5) interacting with the hollow shaft in a region of the slotted end of the hollow shaft (2), wherein upon rotation, the inner shaft creates a pumping effect directed towards the free end (4), the inner shaft (3) has at least one section (6) with a cross section increasing in an axial direction and the cross section increases from a drive side toward the free end (4).

2. Dispersing tool according to claim 1, wherein the cross section of the section (6) is at least point-symmetric relative to a longitudinal middle axis of the inner shaft (3).

3. Dispersing tool according to claim 1, wherein the inner shaft has a plurality of the sections (6) with the increasing cross section.

4. Dispersing tool according to claim 3, wherein two to ten of the sections (6) with the increasing cross section are distributed over a length of the inner shaft (3).

5. Dispersing tool according to claim 3, wherein the sections (6) with the increasing cross section are arranged on the inner shaft (3) with at least generally uniform spacing.

6. Dispersing tool according to claim 3, wherein an open spacing between the sections (6) with the increasing cross section corresponds to approximately one-half to three times an axial dimension of the inner shaft.

7. Dispersing tool according to claim 3, wherein the inner shaft (3) has a smaller spacing between the sections with the increasing cross section in a middle region between the drive side and a working end.

8. Dispersing tool according to claim 3, wherein three or four of the sections (6) with the increasing cross section are distributed over a length of the inner shaft (3).

9. Dispersing tool according to claim 1, wherein an angle enclosed by a meridian line of the section (6) with the increasing cross section and a line parallel to a longitudinal axis of the inner shaft (3) equals approximately 10° to 60°.

10. Dispersing tool according to claim 1, wherein an axial extent of the section (6) with the increasing cross section equals between approximately one-half and two times a greatest diameter of the section (6).

11. Dispersing tool according to claim 1, wherein on an end of one or more of the sections (6) with the increasing cross section facing away from the drive side, there is a generally cylindrical projection, having a diameter corresponding to approximately a greatest diameter of the section.

12. Dispersing tool according to claim 1, wherein the section (6) with the increasing cross section next to the free end (4) is arranged approximately in a mid region of a lateral outlet opening (10) in the hollow shaft (2) or offset relative to the opening in a direction towards the drive.

13. Dispersing tool according to claim 12, wherein the section (6) with the increasing cross section is located completely outside the outlet opening (10) in a direction toward the drive.

14. Dispersing tool according to claim 1, wherein a meridian line of the section (6) with the increasing cross section has a constant profile up to a greatest radial extent having a straight line, convex curve, and/or concave curve profile.

15. Dispersing tool according to claim 14, wherein a meridian line of the section (6) with the increasing cross section extends from a point of its greatest radial extent at an end facing the free end to the inner shaft (3) with a smaller axial extension than the increasing cross section in one of a curved, a straight line, and a straight line in a plane perpendicular to an inner shaft axis.

16. Dispersing tool according to claim 1, wherein the section (6) with the increasing cross section extends out relative to a surface of the inner shaft (3) at least in a region of a greatest cross section.

17. Dispersing tool according to claim 1, wherein a smallest cross section of the section (6) with the increasing cross section corresponds to a cross section of the inner shaft (3).

18. Dispersing tool according to claim 1, wherein a greatest cross section of the section (6) with the increasing cross section corresponds to a cross section of the hollow shaft (2).

19. Dispersing tool according to claim 1, wherein the section (6) with the increasing cross section is rotationally symmetric at least region-by-region and/or has circular cross sections relative to a longitudinal middle axis of the inner shaft (3).

20. Dispersing tool according to claim 1, wherein the inner shaft (3) is manufactured from one or more metallic materials and/or plastics.

21. Dispersing tool according to claim 1, wherein an angle enclosed by a meridian line of the section (6) with the increasing cross section and a line parallel to a longitudinal axis of the inner shaft (3) equals approximately 150° to 45°.

22. Dispersing tool according to claim 1, wherein an angle enclosed by a meridian line of the section (6) with the increasing cross section and a line parallel to a longitudinal axis of the inner shaft (3) equals approximately 20° to 30°.

* * * * *

UNITED STATES PATENT AND TRADEMARK OFFICE

CERTIFICATE OF CORRECTION

PATENT NO. : 7,056,009 B2
APPLICATION NO. : 11/054809
DATED : June 6, 2006
INVENTOR(S) : Peter Jagle et al.

It is certified that error appears in the above-identified patent and that said Letters Patent is hereby corrected as shown below:

Col. 4, line 4, delete "l" (the letter l) and insert therefor --1-- (the number 1).

Col. 7, line 2, delete "150°" and insert therefor --15°--.

Signed and Sealed this

Seventeenth Day of April, 2007

JON W. DUDAS
*Director of the United States Patent and Trademark Office*